US005687850A

United States Patent [19]

Speckhart et al.

[11] Patent Number: 5,687,850

[45] Date of Patent: Nov. 18, 1997

[54] CONVEYOR SYSTEM WITH A COMPUTER CONTROLLED FIRST SORT CONVEYOR

[75] Inventors: Bernard S. Speckhart, Short Hills; Ramon R. Duterte, Jr., Lodi, both of N.J.; Craig M. Davidson, Cardiff, Calif.

[73] Assignee: White Conveyors, Inc., Kenilworth, N.J.

[21] Appl. No.: 504,383

[22] Filed: Jul. 19, 1995

[51] Int. Cl.[6] ..... B03B 9/00

[52] U.S. Cl. ..... 209/2; 209/583; 209/587; 209/937

[58] Field of Search ..... 209/3.3, 583, 587, 209/579, 937, 576, 2; 198/349.6

[56] References Cited

U.S. PATENT DOCUMENTS

| | | | |
|---|---|---|---|
| Re. 24,961 | 4/1961 | Curtis | 118/316 |
| 421,999 | 2/1890 | Williams . | |
| 1,412,631 | 4/1922 | Righter . | |
| 1,861,600 | 6/1932 | Harrison . | |
| 1,998,109 | 4/1935 | Walter, Jr. | 211/1.5 |
| 2,449,669 | 9/1948 | Pohlers | 198/168 |
| 2,536,575 | 1/1951 | Seldin | 198/168 |
| 2,573,334 | 10/1951 | Hitz | 198/173 |
| 2,583,968 | 1/1952 | Rosseau | 263/6 |
| 2,599,615 | 6/1952 | Dahlberg | 198/213 |
| 2,645,186 | 7/1953 | Davis | 104/97 |
| 2,708,501 | 5/1955 | Boehm | 198/27 |
| 2,750,897 | 6/1956 | Davis | 104/96 |
| 2,751,091 | 6/1956 | Freeman | 214/11 |
| 2,846,049 | 8/1958 | Carlson | 198/130 |
| 2,861,676 | 11/1958 | Rasmussen et al. | 198/218 |
| 2,868,354 | 1/1959 | Harrison | 198/177 |
| 2,899,072 | 8/1959 | Weiss | 211/1.5 |
| 2,916,132 | 12/1959 | Leiser | 198/21 |
| 2,918,164 | 12/1959 | Austin et al. | 198/177 |
| 2,947,407 | 8/1960 | Wood | 198/66 |
| 2,952,351 | 9/1960 | Stone | 198/177 |

(List continued on next page.)

FOREIGN PATENT DOCUMENTS

| | | | |
|---|---|---|---|
| 334127 | 7/1933 | Canada . | |
| 690778 | 7/1964 | Canada | 186/11 |
| 726529 | 1/1966 | Canada | 198/22 |
| 1018472 | 10/1977 | Canada | 203/18 |
| 1018931 | 10/1977 | Canada | 203/18 |
| 1140139 | 11/1962 | Germany . | |
| 1205448 | 11/1965 | Germany . | |
| 2525070 | 12/1976 | Germany . | |
| 737325 | 6/1980 | U.S.S.R. . | |
| 1221112 | 3/1986 | U.S.S.R. . | |

OTHER PUBLICATIONS

Master–Veyor brochure, published by Speed Check Conveyor Co. Inc. Decatur, GA, pp. 1–4.

Sorting Carousel brochure, published by Dunnewolt U.S.A. Inc., Dallas, TX, pp. 1–4.

My–T–Veyor brochure, Model No. 830, published by My–T–Veyor, Oxford, MI, pp. 1–3.

Sort–O–Veyor brochure, published by Speed Check Conveyor Co. Inc. Decatur, GA, pp. 1–4.

Quick Assembly brochure, published by Natmar, Inc., Cincinatti, Ohio, pp. 1–2.

Controlling Hospital Garments, Wim Giezeman, Textile Rental, Jun. 1982, pp. 34–36, 38.

*Primary Examiner*—David H. Bollinger

*Attorney, Agent, or Firm*—Kenyon & Kenyon

[57] ABSTRACT

A sorting conveyor system is disclosed having a computer controlled first sort conveyor stage and a final sort conveyor stage. Articles to be sorted are identified and loaded onto a first sort conveyor which sorts the articles into groups and routes each group to one or more holding rails coupled via a transfer rail to one or more final sort conveyors. As a complete group of articles is assembled on one or more holding rails, the group of articles is transferred to a final sort conveyor. Identification information for each article transferred to the final sort conveyor is also transferred to the final sort conveyor. The final sort conveyor then performs a final sort on each group of articles transferred thereto.

8 Claims, 3 Drawing Sheets

U.S. PATENT DOCUMENTS

| | | | |
|---|---|---|---|
| 2,987,170 | 6/1961 | Hamilton | 198/213 |
| 2,998,136 | 8/1961 | Gerisch | 209/81 |
| 3,008,562 | 11/1961 | Ohrnell | 198/26 |
| 3,017,025 | 1/1962 | Stephen | 209/81 |
| 3,090,481 | 5/1963 | Biel et al. | 198/221 |
| 3,113,659 | 12/1963 | Oda et al. | 198/25 |
| 3,124,236 | 3/1964 | Gerisch | 198/169 |
| 3,148,765 | 9/1964 | Weiss et al. | 198/213 |
| 3,151,730 | 10/1964 | Bünten | 198/38 |
| 3,152,682 | 10/1964 | Rutkovsky et al. | 198/38 |
| 3,164,245 | 1/1965 | Juengel | 198/129 |
| 3,171,536 | 3/1965 | Johnson | 198/465.4 |
| 3,178,012 | 4/1965 | Weiss et al. | 198/213 |
| 3,184,042 | 5/1965 | Rutkovsky et al. | 198/177 |
| 3,194,383 | 7/1965 | Kuwertz | 198/38 |
| 3,200,933 | 8/1965 | Schenk et al. | 198/38 |
| 3,247,952 | 4/1966 | Kozlosky | 198/173 |
| 3,403,767 | 10/1968 | Gerisch | 198/20 |
| 3,415,352 | 12/1968 | Gerisch | 198/38 |
| 3,422,950 | 1/1969 | Bachmann | 198/177 |
| 3,454,148 | 7/1969 | Harrison | 198/28 |
| 3,469,667 | 9/1969 | Gerisch | 193/40 |
| 3,511,359 | 5/1970 | Gerisch | 198/126 |
| 3,557,935 | 1/1971 | Gerisch | 198/38 |
| 3,580,378 | 5/1971 | Pedersen | 198/25 |
| 3,581,887 | 6/1971 | Radutsky et al. | 209/73 |
| 3,622,000 | 11/1971 | McClenny | 209/121 |
| 3,684,078 | 8/1972 | Nielsen | 198/33 |
| 3,707,925 | 1/1973 | Byrnes, Sr. | 104/167 |
| 3,780,852 | 12/1973 | Speckhart et al. | 198/181 |
| 3,786,911 | 1/1974 | Milazzo | 198/219 |
| 3,799,318 | 3/1974 | Dekoekkoek | 198/26 |
| 3,860,351 | 1/1975 | Weiss et al. | 403/218 |
| 3,917,112 | 11/1975 | Willis et al. | 221/1 |
| 3,942,340 | 3/1976 | Kirkby | 68/3 R |
| 3,961,699 | 6/1976 | Hirsch | 198/26 |
| 4,018,327 | 4/1977 | Goodman et al. | 198/723 |
| 4,022,338 | 5/1977 | Laursen | 214/89 |
| 4,027,598 | 6/1977 | Swilley | 104/162 |
| 4,036,365 | 7/1977 | Rosenfeld | 209/73 |
| 4,180,152 | 12/1979 | Sefcik | 198/377 |
| 4,214,663 | 7/1980 | Schopp et al. | 209/552 |
| 4,239,435 | 12/1980 | Weiss et al. | 414/136 |
| 4,303,503 | 12/1981 | de Mimerand et al. | 209/3.3 |
| 4,763,773 | 8/1988 | Kawarabashi et al. | 198/409 |
| 4,817,778 | 4/1989 | Davidson | 198/346.1 |
| 4,875,416 | 10/1989 | Duce | 104/167 |
| 4,903,819 | 2/1990 | Heinold et al. | 198/465.4 |
| 4,907,699 | 3/1990 | Butcher et al. | 209/3.3 |
| 4,943,198 | 7/1990 | McCabe | 414/13 |
| 4,977,996 | 12/1990 | Duce | 198/349.95 |
| 4,991,719 | 2/1991 | Butcher et al. | 209/3.3 |
| 4,995,531 | 2/1991 | Summers | 221/75 |
| 5,000,309 | 3/1991 | Dooley | 198/680 |
| 5,005,691 | 4/1991 | Jennewein et al. | 198/465 |
| 5,072,822 | 12/1991 | Smith | 209/937 X |
| 5,113,995 | 5/1992 | Sakurai | 198/409 |
| 5,141,094 | 8/1992 | Speckhart et al. | 198/349 |
| 5,143,201 | 9/1992 | Speckhart et al. | 198/502.3 |
| 5,154,275 | 10/1992 | Speckhart et al. | 198/416 |
| 5,193,686 | 3/1993 | Speckhart et al. | 209/3.3 |
| 5,220,511 | 6/1993 | Speckhart et al. | 364/478 |
| 5,238,122 | 8/1993 | Hart | 209/937 X |
| 5,269,402 | 12/1993 | Speckhart et al. | 198/416 |
| 5,299,134 | 3/1994 | Speckhart et al. | 364/478 |
| 5,351,803 | 10/1994 | Speckhart et al. | 198/464.3 |
| 5,451,234 | 9/1995 | Wassermann | 606/203 |

CONVEYOR SYSTEM WITH A COMPUTER CONTROLLED FIRST SORT CONVEYOR

FIELD OF THE INVENTION

The present invention relates generally to the field of sorting a collection of randomly arranged articles into a desired order, and particularly to sorting a collection of such articles that are loaded onto a sorting conveyor system.

BACKGROUND INFORMATION

When performing a complete sort of any given group or batch of articles, the performance of a sorting conveyor, such as the 5-latch "COMP-U-SORT" conveyor, manufactured by White Conveyors Inc. of Kenilworth, N.J., is determined by the length of the conveyor, the number of selection (or "drop") stations and the number of articles loaded onto the conveyor. For a given mix of articles and number of drop stations, the time to sort is proportional to the product of the length of the conveyor and the number of articles loaded onto the conveyor.

Because of the relationship of the sort time to the length of the conveyor, maximum system performance is achieved with a minimum length conveyor. A conventional sorting conveyor is a batch system which requires all the items that are to be sorted to be loaded on the conveyor at once. This batch sorting function sets a minimum length of the conveyor based on the desired work flow or article mix. Manual presorting sorting systems cannot easily divide the work flow into small logical batches and ensure that the batches will fit on the conveyor performing the final sort.

In an industrial laundry or dry-cleaning plant, garments are sorted into categories which correspond to the logical groups that are handled when returning the garments. The coarsest division of the sort is typically by delivery truck or route. Once all the garments that are to be returned on the same truck are grouped together, the garments are sorted further into groups by account number, stop or store. Within each account, the garments are sorted by wearer and possibly by garment type (e.g., pants, shirts). Uniform rental plants, for example, might sort garments by route, account and wearer, while a wholesale dry-cleaning plant might sort them by truck, store and ticket. While the actual sorting categories may vary, the sorting requirements are essentially the same.

During processing of the garments (or "production"), one or more routes may be grouped together into a single batch. Conversely, large routes may be split into smaller batches. The definition of a batch depends on the processing equipment installed in the plant. The sorting of garments into batches is accomplished by a first sort operation.

As the garments are being processed, some garments might be delayed for various reasons and be separated from others in the same route or account. Garments which are separated in this manner are called "stragglers." Before garments are returned to their correct destinations, all stragglers must be accounted for and found.

An accurate first sort of garments into batches is accomplished when all the garments, including the stragglers, are loaded onto a final sort conveyor. If any garments are missing, however, manual insertion of the missing garment is required, thereby negating some of the advantages of using automatic sorting equipment.

Traditionally, a first sort of garments is performed manually or with the assistance of a simple conveyor system. Each garment is identified by a human-readable label which is read by a sort operator. The operator then places each garment at a particular location on the sorting conveyor which will depend upon the contents of the label.

The manual first sort process, however, has several drawbacks.

First, only a limited number of sort breaks is possible with a manual first sort. Garments destined for different groups in the sort must be placed on the conveyor at physically separate locations. The limited reach of the human operator limits the number of sort breaks possible.

Second, the human-readable labels are hard to change. Because the sort criteria are based on information printed on the label, the label must be changed in order to change how the garment is sorted. A lookup may be used to cross-reference accounts to routes, but only in a limited manner and with an increase of errors.

Third, a human reading the label and placing the garment on the conveyor is prone to make errors.

Fourth, there is no count or identity of missing garments. As such, with a manual first sort, one cannot be sure that all the stragglers have been found and that it is therefore safe to proceed to the final sort.

Finally, because the number of sort breaks is limited, the manual first sort must be by a large group such as by route. This results in the final sort conveyor being sized for the largest route, a size which is not necessarily the most efficient size for the conveyor.

SUMMARY OF THE INVENTION

The present invention provides a computerized method and apparatus for performing a first sort of articles, such as garments, on a conveyor system. The method of the present invention includes five major steps.

The first step entails the creation of a lookup table which defines the batches the garments are to be divided into.

The second step involves identifying the garments to be sorted to a computer which controls the sorting process. Each garment includes identification information attached thereto which can be, for example, either a bar code label, key punched data or an RF ID. A location on the conveyor on which the garment is placed is added to the attached identification information to completely identify the garment to the controlling computer.

The control computer then uses the garment identification information to look up the group to which the garment belongs.

The garment is then routed to a holding rail with other members of its group. A new holding rail is allocated if needed.

Once all garments in a group are collected on a holding rail, the garments are transported by a transfer rail to the final sort conveyor. In addition, the identification information for each garment transported to the final sort conveyor is transferred, for instance via an electronic link, to a computer controlling the final sort conveyor.

The computerized first sort method and apparatus of the present invention have several advantages over the traditional, manual first sort.

First, unlike a manual first sort, there is no physical limitation on the number of drop stations possible with the computerized first sort conveyor, thereby allowing unlimited breaks. This allows the separation of garments into several smaller groups. In addition, the garments may be pre-sorted by garment type to allow the final sort to order the garments by type with no additional overhead.

Second, automatic allocation of sort rails is possible with the present invention. The manual first sort system by its very nature requires rails to be allocated to specific garment groups. The computerized system of the present invention can allocate rails on an as-needed basis, thus making more efficient use of available factory space.

Third, arbitrary group divisions are possible with the computerized first sort of the present invention. Since the group division is made through a look-up table, the group divisions can change on an as-needed basis. The groups into which articles are sorted by the first sort of the present invention can be any multiple of the smallest sub-division, which in an exemplary garment processing application is usually the wearer or ticket. This also allows the use of smaller final sort conveyors, thus reducing the overall sort time. In this way, the first sort of the present invention makes it possible to optimize the performance of the entire sorting system.

Fourth, data collected during the identification procedure of the first sort process of the present invention is reused. As the data is collected when garments are identified for the first sort, the garment identification is used to count the number of garments in a group and to thus isolate the missing stragglers. The number of garments as well as the identity of the garments stored on the first sort conveyor is accessible by the factory management system. When the garments are transferred to the final sort, their order is maintained and the garment identification information is passed on to the final sort as well.

The computerized first sort conveyor of the present invention can be used in conjunction with one or more sorting conveyors performing the final sort.

DETAILED DESCRIPTION OF THE DRAWINGS

Figure 1:
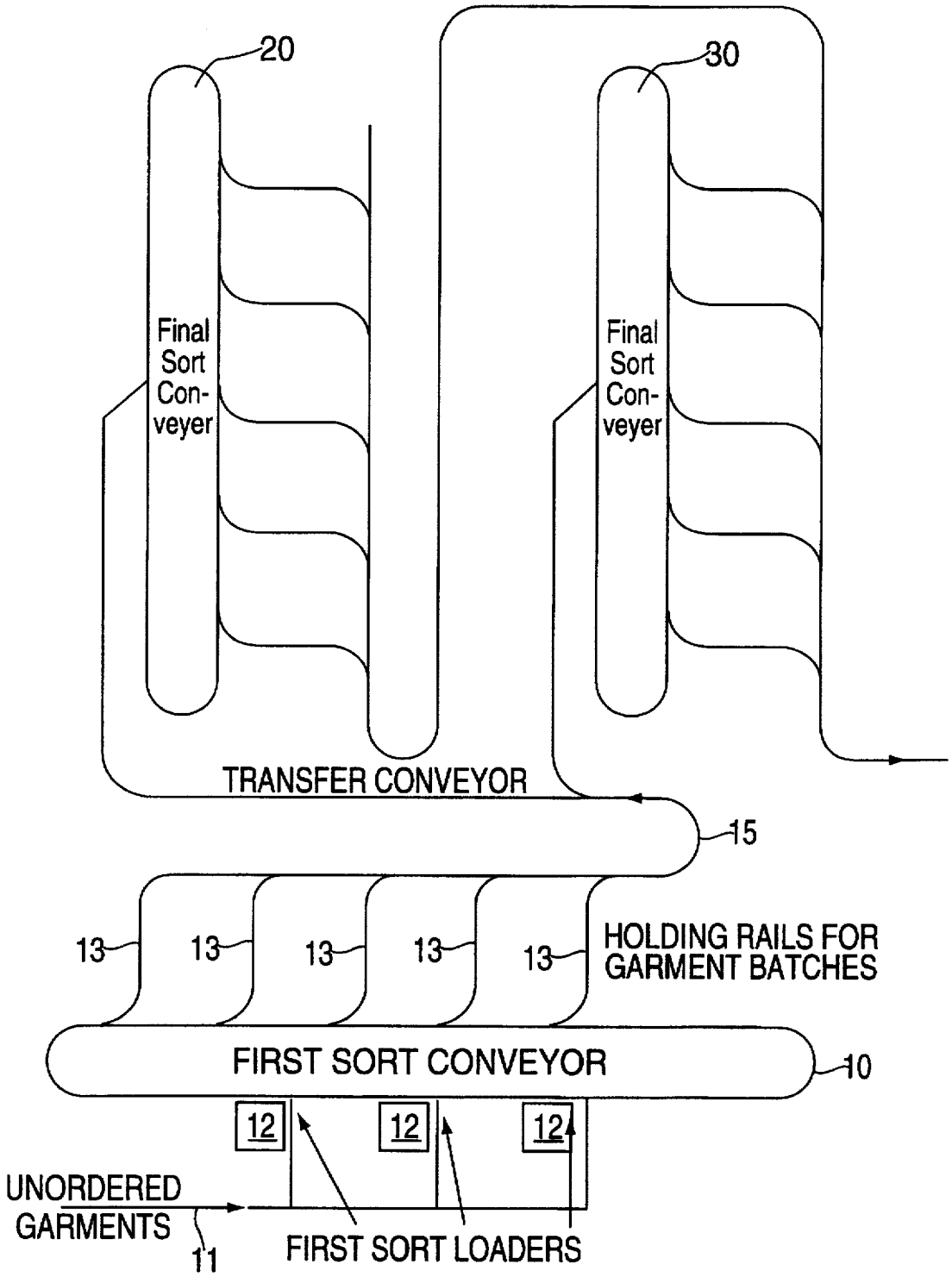
FIG. 1 shows a two-stage sorting system in accordance with the present invention.

FIG. 1 shows an exemplary two-stage sorting system in accordance with the present invention. The exemplary system of FIG. 1 includes one first sort conveyor 10 and two final sort conveyors 20 and 30. It should be clear, however, that other configurations are also possible. Typically, one first sort conveyor is used in conjunction with 1 to 3 final sort conveyors.

Unordered garments are first placed onto a conveyor 11 which conveys the unordered garments to the first sort conveyor 10 via one or more loaders 12. The first sort conveyor 10 and the conveyor 11 can be implemented using any conventional conveyor mechanism adapted to conveying the type of article of interest. For garments, a conveyor with a single-latch per carrier mechanism can be used. The operation of the first sort conveyor 10 and of the final sort conveyors 20 and 30 is under the control of one or more computers (not shown). Each conveyor could be under the direct control of a separate computer or all conveyors can be under the control of a central computer. In the case of separate computers, the various computers are linked as will be described in greater detail below. In addition, there may be a plant management computer (not shown) which in addition to other possible functions, oversees the operation of the conveyor system. It should be readily apparent to a person of ordinary skill in the art that a variety of computer architectures are possible for controlling the sorting conveyor system of the present invention.

Each loader 12 can be implemented in accordance with U.S. patent application Ser. No. 08/504,269, entitled "Single Latch Loader and Method for Loading", filed on even date herewith and assigned in common with the present application to White Conveyors Inc. of Kenilworth, N.J., and which is hereby incorporated by reference as if set forth fully herein.

The first sort conveyor 10 places sorted batches of garments onto one or more holding rails 13 coupled to the first sort conveyor. The holding rails 13 can be implemented in accordance with U.S. patent application Ser. No. 08/504,269, entitled "Powered Storage Rail for Transporting Articles", filed on even date herewith and being assigned in common with the present application to White Conveyors Inc. of Kenilworth, N.J., and which is hereby incorporated by reference as if set forth fully herein. Batches of garments on the holding rails 13 are transported via a transfer conveyor 15 to the one or more final sort conveyors 20 and 30. The transfer conveyor 15 can be implemented with a "Contin-U-Veyor" conveyor manufactured by White Conveyors Inc. of Kenilworth, N.J. The final sort conveyors can be 5-latch "COMP-U-SORT" conveyors manufactured by White Conveyors Inc. of Kenilworth, N.J. and described in U.S. Pat. No. 5,143,201, entitled "Carrier Assembly" and U.S. Pat. No. 5,220,511, entitled "Computer Control System and Method for Sorting Articles on a Conveyor", both assigned in common with the present application to White Conveyors Inc. of Kenilworth, N.J., and being hereby incorporated by reference as if set forth fully herein.

In an exemplary embodiment of the present invention, the first sort conveyor 10 can handle approximately 5,000 articles per hour (or approximately 40,000 articles per day). For greater throughput, a manual pre-sort can be performed prior to the first sort.

The operation of the conveyor system of the present invention will now be described in greater detail.

Figure 2:
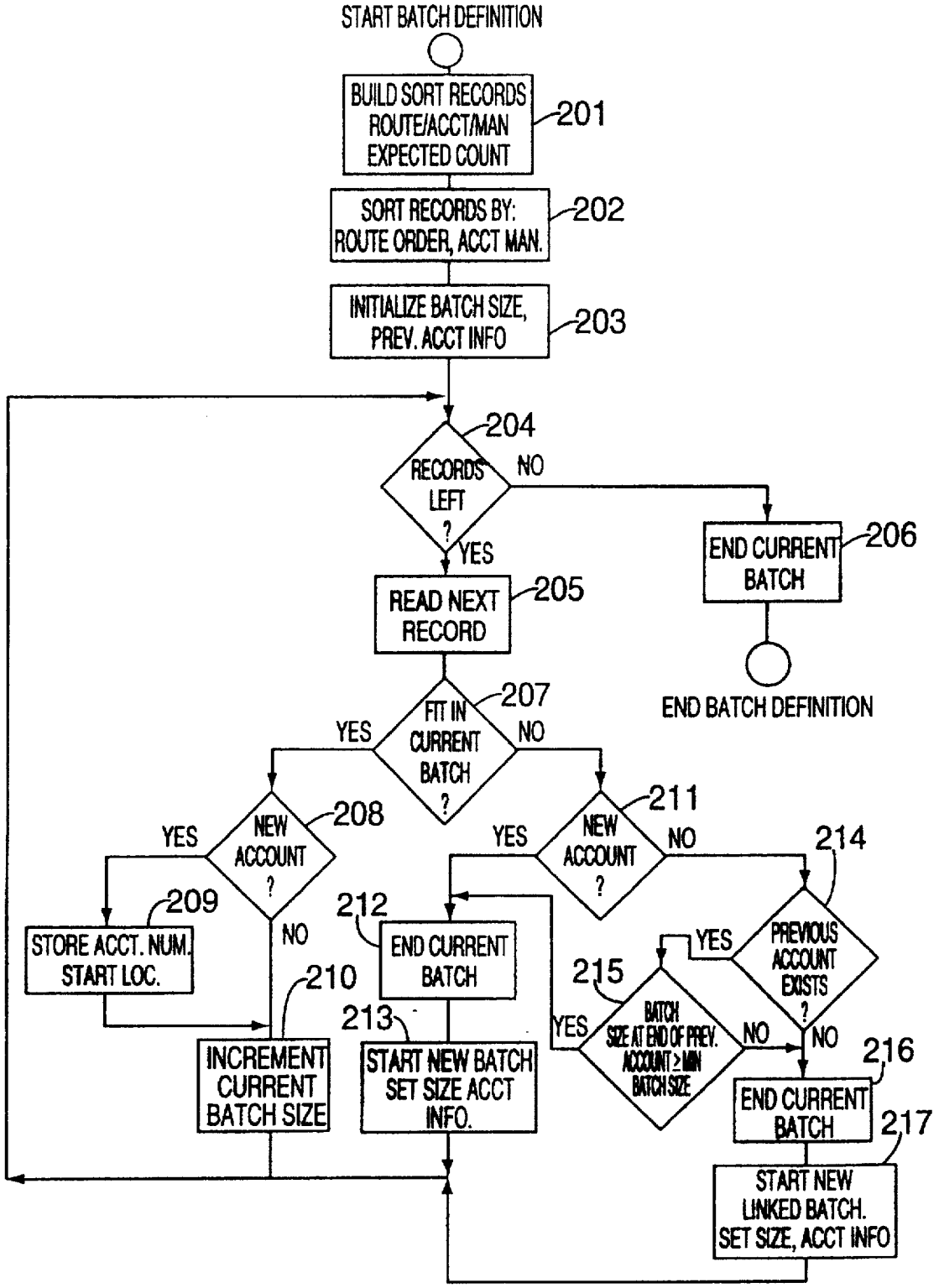
FIG. 2 is a flow-chart illustrating a procedure for defining batches of garments, in accordance with the present invention.

Before any sorting of the garments takes place, a batch definition procedure, or routine, must be carried out. Such a procedure is illustrated in FIG. 2. The batch definition routine is used to build the look-up tables used in the computerized first sort of the present invention. The batch definition routine may be performed by the plant management computer or a sorter control computer.

The batch definition procedure creates batches which most closely match the size of the final sort conveyor(s). The size of the final sort conveyor and a user-defined minimum batch size must be provided to the batch definition routine.

The first step 201 of the batch definition routine is to build a work file with the expected work for a given shift or time period. For example, the work file can be created once a day for the work to be performed that day. The work file comprises a plurality of records, with each record containing information for a particular customer, or wearer. For an industrial laundry facility, each record in the work file typically includes a route sequence number, an account number, a wearer number and an expected number of garments for the wearer. The expected number of garments could be a number previously contracted for the wearer or can be determined, for instance, by a count taken when the garments are picked up from the wearer. For a wholesale dry-cleaning plant, each record in the work file would typically include a route sequence number, a store number, a ticket number and the number of garments on each ticket. It should be noted that in each record, a route sequence is used instead of a route number. The route sequence numbers indicate the order in which the delivery routes are expected to be completed that day.

Once the records are created, they are sorted at step 202 in ascending order of route sequence number, and for each route in ascending order of account number, and for each account number in ascending order of wearer number. Any commonly available sort algorithm may be used to perform the sorting in step 202.

At step 203, before starting the build of the new batch definition records, variables indicating the current batch size, the account number in the second-to-last record read (or the "previous account"), and a pointer to the first record in the current batch (the "start point") are all initialized. In the following steps, each record in the work file is read, at step 205, until it is determined, at step 204, that all records in the work file have been read, in which case the batch definition routine is terminated at step 206. If it is determined at step 207 that the number of garments for the current record when added to the current size of the batch do not exceed the size of the final sort conveyor, the record count is added to the current batch size at step 210. If it is determined at step 208 that the current record is for a new account number, i.e., the first account number in a batch or an account number different than that of the previous record, then at step 209, the new account number, the location or index of the current record within the sorted work file (i.e., the start location of the new account) and the batch count before the current record was read, are temporarily stored (e.g., in the RAM of the computer executing the routine) before proceeding to step 210.

If, however, it is determined at step 207 that the current record count when added to the current batch would exceed the capacity of the final sort conveyor, operation proceeds to step 211 in which it is determined whether the current record is for a new account. If the current record is for a new account, the current batch is ended, at step 212. When a batch is ended, look-up records for all account numbers and wearer numbers in the batch are generated. A new batch is then started at step 213 with the size of the current record as the current batch size.

If adding the current record to the current batch would exceed the capacity of the conveyor, as determined in step 207, and if it is determined at step 211 that the account number in the current record is the same as the account number in the previous record, a check is then performed to determine where the account started using the information temporarily stored in step 209. If it is determined at step 214 that a previous account exists, i.e., that the current account is not the first account, and if it is determined in step 215 that the batch count at the end of the previous account was larger than or equal to the minimum batch size specified, then the current batch is ended at step 212 and a new batch is started at step 213. The new batch starts at the start location of the current account (stored in step 209) and includes the current record.

If it is determined at step 214 that there is no previous account, or if it is determined in step 215 that the previous account would make the batch too small (i.e., that the batch count at the end of the previous account is smaller than the minimum batch size), the current batch is ended at step 216 and a new linked batch is started at step 217. A linked batch must follow the preceding batch through the final sort conveyor.

As a result of the batch definition routine described above, a batch assignment table is generated which includes the route, account and wearer information for each garment in each of the several batches defined.

Once the batch definition procedure described above is completed, the next procedure in carrying out the present invention is to identify each garment to the controlling computer.

Each garment is identified as it is loaded onto the first sort conveyor 10 at one of the loaders 12 (FIG. 1). The garments may have a human-readable label, the contents of which are entered by an operator on a keypad, a bar coded label which is read by a bar code scanner, an RF tag which is read by an RF reader, or any other suitable identification means. The identification information on each garment label would typically include the route, account and wearer numbers for the garment to which the label is attached.

The garments may have their identities resolved either before or after the garments have been loaded on the first sort conveyor 10. Each garment identification includes the relevant contents of the garment label as well as information indicating where on the conveyor 10 the garment has been placed, i.e., the garment's conveyor location. The matching of each garment's label information to each garment's conveyor location is the task of each of the loading mechanisms 12.

An example of a garment identification and scanning system that can be used in the present invention is described in U.S. Pat. No. 5,299,134 assigned in common with the present application to White Conveyors Inc. of Kenilworth, N.J., and hereby incorporated by reference as if set forth fully herein.

Figure 3:
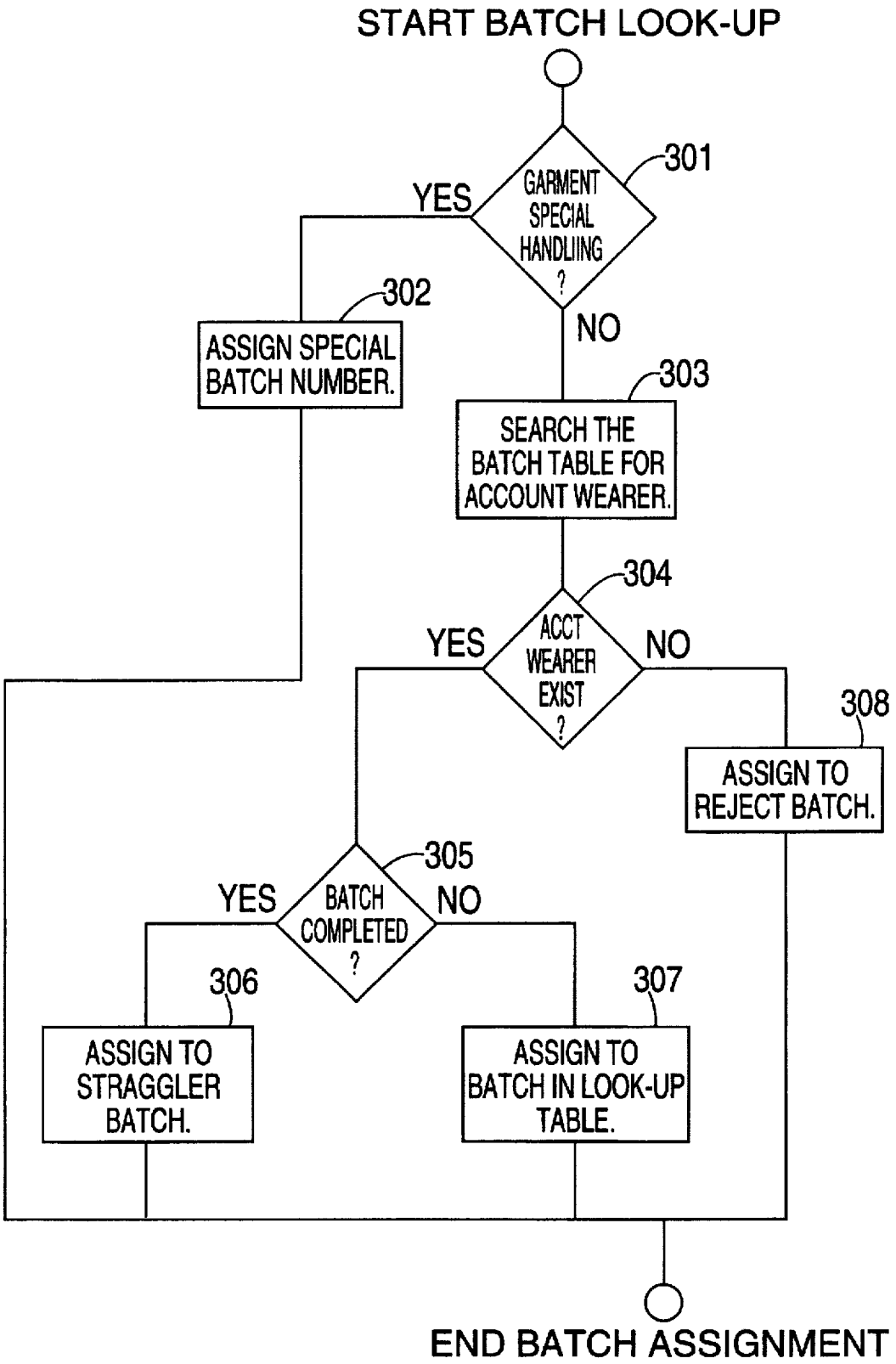
FIG. 3 is a flow-chart illustrating a procedure for assigning a garment to a batch, in accordance with the present invention.

Using the identification information, the sorting system of the present invention determines the batch to which each garment belongs. FIG. 3 is a flow-chart illustrating a routine for assigning each garment to its appropriate batch. The routine of FIG. 3 is typically performed by the computer controlling the operation of the first sort conveyor.

Individual garments may be marked as requiring special handling. Examples of special handling are return to stock or repair. When a garment identification is received from a loader 12, the identification is first checked at step 301 to determine whether the garment requires special handling. If a garment requires special handling, the garment is assigned, at step 302, to the appropriate special handling batch. If the garment does not require special handling, the batch assignment table is searched in step 303 for the account number and wearer number indicated in the garment's identification information. If at step 304 it is determined that the account and wearer numbers are in the batch assignment table, operation branches to step 305 in which it is checked whether the batch to which the current garment belongs has been completed. If the batch has been completed, the garment is assigned, at step 306, to a straggler batch. If at step 305 it is determined that the garment's batch has not been completed, the garment is assigned, at step 307, to the batch indicated in the garment's identification information.

If at step 304 the account and wearer numbers cannot be found in the batch assignment table, the garment was not expected. Unexpected garments could be assigned, at step 308, to a special batch or to a reject batch.

Once the process of identifying a garment to the controlling computer is completed, the next procedure in carrying out the first sort of the present invention entails assigning each garment to a holding rail 13.

Holding rails 13 in the system of the present invention can either be assigned in a fixed manner for the special handling of garments, or allocated to a pool which can be used by any batch of garments. When the system is first started and is clear of garments, all the rails in the rail pool are empty and available.

After a garment is assigned to a batch, the assigned rails are searched for a rail holding the same batch and allowable garment type. If an assigned rail is found that has room for more garments, the garment is sent to that rail. If there is no currently assigned rail that can take the garment, the sort controlling computer searches for a free holding rail in the rail pool. If a free holding rail is available, the rail is then assigned to the batch and garment type that is needed, and the garment is sent to that rail. It should be noted that multiple rails can be assigned to one batch.

Once the first sort conveyor 10 has routed a complete batch to the holding rails, the one or more rails holding the batch are unloaded onto the transfer conveyor 15 and the garments are moved to a final sort conveyor 20 or 30. As the garments are transported on the transfer conveyor 15, the contents of the labels of the garments are transferred to the computer in control of the final sort. As discussed above, it should be apparent that the same computer which controls the first sort can also be used to control the final sort, in which case this step would simply entail transferring the identification information to the appropriate control program or routine executed by the computer.

The garment identification label contents are transferred to the final sort computer in the same order as the corresponding garments are transferred to the final sort conveyor 20 or 30. The method of transfer of the data can be by any commonly used data exchange mechanism, including serial data communication (e.g., RS-232 or RS-485), shared disk, high speed network (e.g., Ethernet, FDDI, ATM), factory control bus, radio frequency or shared memory. The transfer mechanism must, however, preserve the ordering of the data.

The final sort conveyor controller can use the data from the first sort controller to perform the final ordering of the garments. The final sort conveyor may optionally re-scan any or all of the garments to verify the correctness of the data and to ensure the final sort will be performed correctly.

What is claimed is:

1. A sorting conveyor system comprising:

an initial conveyor for receiving unsorted articles;

at least one loader coupled to the initial conveyor;

a first sort conveyor coupled to the at least one loader;

a plurality of holding rails coupled to the first sort conveyor;

a transfer conveyor coupled to the plurality of holding rails; and at least one final sort conveyor coupled to the transfer conveyor, wherein:

the unsorted articles on the initial conveyor are identified and loaded onto the first sort conveyor by the at least one loader;

the first sort conveyor sorts the unsorted articles into a plurality of groups of articles and routes the groups of articles to the holding rails;

the transfer conveyor transfers the groups of articles from the holding rails to the at least one final sort conveyor; and identification information for each article transferred to the final sort conveyor is transferred from the at least one loader to the at least one final sort conveyor.

2. The sorting conveyor system of claim 1, wherein the at least one loader includes an identification information input device selected from the group of input devices consisting of a keypad, a bar code scanner and an RF tag reader.

3. The sorting conveyor system of claim 1, wherein:

the at least one loader includes a conveyor location identification device for identifying a location on the first sort conveyor at which an article is loaded onto the first sort conveyor, and the identification information for each article loaded onto the first sort conveyor includes the location on the first sort conveyor at which the article is loaded.

4. The sorting conveyor system of claim 1, wherein the number of articles in each group of articles transferred to the at least one final sort conveyor is less than or equal to a capacity of the at least one final sort conveyor.

5. A method for sorting articles, comprising the steps of:

creating a lookup table which defines groups the articles are to be divided into;

loading the articles to be sorted onto a first sort conveyor;

scanning and storing identification information for each of the articles to be sorted;

determining the group to which each article belongs;

routing each article to a holding rail with other articles belonging to the same group;

transferring a group of articles to a final sort conveyor; and transferring the identification information to the final sort conveyor for each article transferred to the final sort conveyor.

6. The method of claim 5, wherein the identification information for each of the articles to be sorted includes a location on the first sort conveyor at which each article has been loaded.

7. The method of claim 5, wherein the number of articles in each group of articles transferred to the at least one final sort conveyor is less than or equal to a capacity of the at least one final sort conveyor.

8. The method of claim 5, further comprising the step of counting a number of articles in each group loaded onto the first sort conveyor.

* * * * *